United States Patent [19]

Bernardin

[11] Patent Number: 4,653,971

[45] Date of Patent: Mar. 31, 1987

[54] DEVICE FOR SELECTIVELY POSITIONING A TOOL CARRIED BY A VEHICLE MOVING ON THE PERFORATED PLATE OF A BANK OF TUBES

[75] Inventor: Michel Bernardin, Villeneuve, France

[73] Assignee: The Societe Anonyme Barras-Provence, Zone Industrielle Saint-Joseph, France

[21] Appl. No.: 736,755

[22] Filed: May 22, 1985

[30] Foreign Application Priority Data

Jun. 22, 1984 [FR] France ..... 84 10008

[51] Int. Cl.[4] ..... B25J 3/00

[52] U.S. Cl. ..... 414/8; 165/11.2; 414/750

[58] Field of Search ..... 414/1, 5, 8, 750, 751; 165/11.1, 11.2, 76

[56] References Cited

U.S. PATENT DOCUMENTS

| | | | |
|---|---|---|---|
| 4,018,344 | 4/1977 | Leshem | 414/750 X |
| 4,303,368 | 12/1981 | Dent et al. | 165/76 |
| 4,363,592 | 12/1982 | Tedder | 414/728 X |
| 4,393,920 | 7/1983 | Shima et al. | 165/11.2 |
| 4,449,599 | 5/1984 | Creek | 414/750 X |

FOREIGN PATENT DOCUMENTS

| | | |
|---|---|---|
| 0014616 | 8/1980 | European Pat. Off. . |
| 0030484 | 6/1981 | European Pat. Off. . |
| 2552341 | 6/1976 | Fed. Rep. of Germany . |
| 2394374 | 1/1979 | France . |

*Primary Examiner*—L. J. Paperner
*Assistant Examiner*—Donald W. Underwood
*Attorney, Agent, or Firm*—Balogh, Osann, Kramer, Dvorak, Genova & Traub

[57] ABSTRACT

The invention relates to a device for selectively positioning a tool carried by a vehicle moving on the perforated plate of a bank of tubes, said device being composed of a vehicle comprising transfer members mounted to slide in a central body and comprising on either side thereof jacks extending at right angles to the planes in which said members move and of which the mobile rods of said jacks comprise at their free end positioning fingers, which vehicle is connected by swivel joint means to an articulated telescopic arm comprising means for fixation to the opening giving access to the enclosure, which arm maintains the vehicle, in the course of its displacements in the enclosure, permanently in contact with said perforated plate. The invention is more particularly applicable to the maintenance of apparatus comprising banks of tubes, in particular steam generators of nuclear power stations.

19 Claims, 9 Drawing Figures

DEVICE FOR SELECTIVELY POSITIONING A TOOL CARRIED BY A VEHICLE MOVING ON THE PERFORATED PLATE OF A BANK OF TUBES

The present invention relates to a device for selectively positioning a tool carried by a vehicle moving on the perforated plate of a bank of tubes.

The technical sector of the invention is that of equipment for repair and for maintenance of the bank of tubes of apparatus such as for example condensers, steam generators or the like.

In the case of steam generators of a nuclear power station, in particular, it is known that the tubes constituting the bank of tubes of these apparatus are periodically checked with a view to detecting possible corrosion by means of an eddy current probe, which is engaged successively in the tubes of the bank of tubes. This probe is disposed in a supple guide tube which is placed successively opposite each of the tubes and is connected to an apparatus for processing the signal that it emits. Equipment of this type is perfectly well known at the present time. Other interventions must be made on these tubes during operation: cleaning, stopping of deteriorated tubes, etc . . . As all this work is carried out in a highly radio-active medium, the operations must be carried out in the most automated manner possible in order to avoid human intervention in these dangerous zones to a maximum.

One known equipment consists in a mobile unit which carries the tool to be positioned in front of each tube comprising two arms each provided with hooking members comprising elements adapted to penetrate in the tubes of the plate to hook thereon. These two arms are mobile with respect to each other in three perpendicular directions of which one is perpendicular to the plate. The two arms are adapted to move parallel to the plate at amplitudes corresponding to whole multiples of the pitch of the tubes.

To allow said mobile unit to be positioned against the perforated plate which covers the water tank of the steam generator, it has been provided to associate it with a transfer equipment comprising a rectilinear pole passed through the man-hole of the water tank and fixed in pivoted manner to the man-hole and which guides a carriage provided with coupling means to allow the carriage to take over said unit during its transfer: from outside the water tank to inside said tank until it reaches the perforated plate and can be disconnected from the bearing carriage in order to move parallel to the tubular plate by being suspended therefrom.

Said transfer equipment further comprises a mast mounted to pivot on the pole for guiding the bearing carriage, which mast comprises, at its free end, centering means which cooperate with tubes of the bank of tubes and enable said mast to be positioned in a reference position.

During scanning of the bank of tubes, the mast remains in position permanently, the pole being tipped into inclined position in the water tank to allow the mobile unit to move.

In this design and as the mast remains in position during the movement of the mobile unit, it is not possible to check the tubes in which the means for positioning the mast are engaged, precisely as the holes of the plate which accomodate said centering means are occupied thereby.

Likewise, the mobile unit being suspended from the perforated plate, it can only operate correctly if said plate is in horizontal position.

Moreover, the unit cannot be displaced and stopped in work position in those zones of the plate not provided with tubes and in the event of these tubes having been obturated at manufacture.

It is an object of the present invention to overcome these drawbacks.

The object to be attained is a device for scanning the bank of tubes of an apparatus, such as, by way of non-limiting example, a steam generator, installed in a dangerous zone, for example a radioactive zone and adapted to be introduced into the water tank of said apparatus and positioned against the perforated plate of the bank of tubes by an operator intervening from outside said apparatus and adapted to operate whatever the vertical or horizontal position of said plate.

This object is attained by the device according to the invention for selectively positioning a tool carried by a vehicle on the perforated plate of a bank of tubes regularly distributed and fixed to the plate to present the tool successively in front of each tube, which plate is located in an enclosure comprising an opening giving access, of which the vehicle comprises two superposed transfer members moving in parallel planes and in two perpendicular directions, which members comprise means for causing positioning fingers to penetrate in said tubes or for causing said fingers to leave said tubes, the fingers of one of the members penetrating in the tubes whilst the fingers of the other are retracted to allow the displacement of the member which carries them at a pitch corresponding to that of the perforations of the perforated plate and to obtain the displacement of the vehicle against said plate, at least one of said members comprising a tool support, said device further comprising means for introducing said vehicle in said enclosure in which said transfer members are mounted to slide in a central body and comprise on either side thereof, jacks extending at right angles to said planes in which said members move and of which the mobile rods of said jacks comprise, at their free end, said positioning fingers, which vehicle is connected by swivel joint means to an articulated telescopic arm comprising means for fixation to said opening giving access to the enclosure, which arm maintains the vehicle, in the course of its displacements in the enclosure, permanently in contact with said perforated plate.

In one embodiment, the central body of the vehicle takes the form of a straight parallelepipedic block and each transfer member comprises two assemblies of two jacks connected together by rods which pass through said body which rods are parallel to one another, to the upper and lower faces of the body and to two of its lateral faces, which assemblies are connected together by spacers perpendicular to said rods, each spacer connecting a jack of one assembly and a jack of the other located on the same side, which spacers are parallel to one another and to the other two lateral faces of the central body.

According to one embodiment, the telescopic arm is composed of two parts articulated one on the other, the assembly being mounted to tip on a frame fixed to the opening giving access to the enclosure and extending therein, the part connected to the frame being of fixed length, the other part which is articulated thereon being telescopic and comprising, at its free end, a swivel joint which cooperates with a spherical housing reserved in the central part of the body of the vehicle and means for coupling the vehicle to said arm; means for controlling the folding of the telescopic part against that part of the arm connected to the frame or the unfolding of said telescopic part and means for placing the arm in line with the frame or for controlling tipping thereof in the enclosure with a view to placing the vehicle in position of operation in contact with the central part of the perforated plate.

The telescopic part of the arm is connected to the other by means of a swivel joint.

The invention results in an automat for making interventions on all the tubes of a bank of tubes of an apparatus such as a condenser, a steam generator or the like without any human intervention inside the apparatus and whatever its horizontal or vertical disposition, the different members being controlled from outside the apparatus in complete safety.

The invention will be more readily understood on reading the following description with reference to the accompanying drawings, in which.

Reference will firstly be made to FIGS. 1 to 4.

Figure 4:
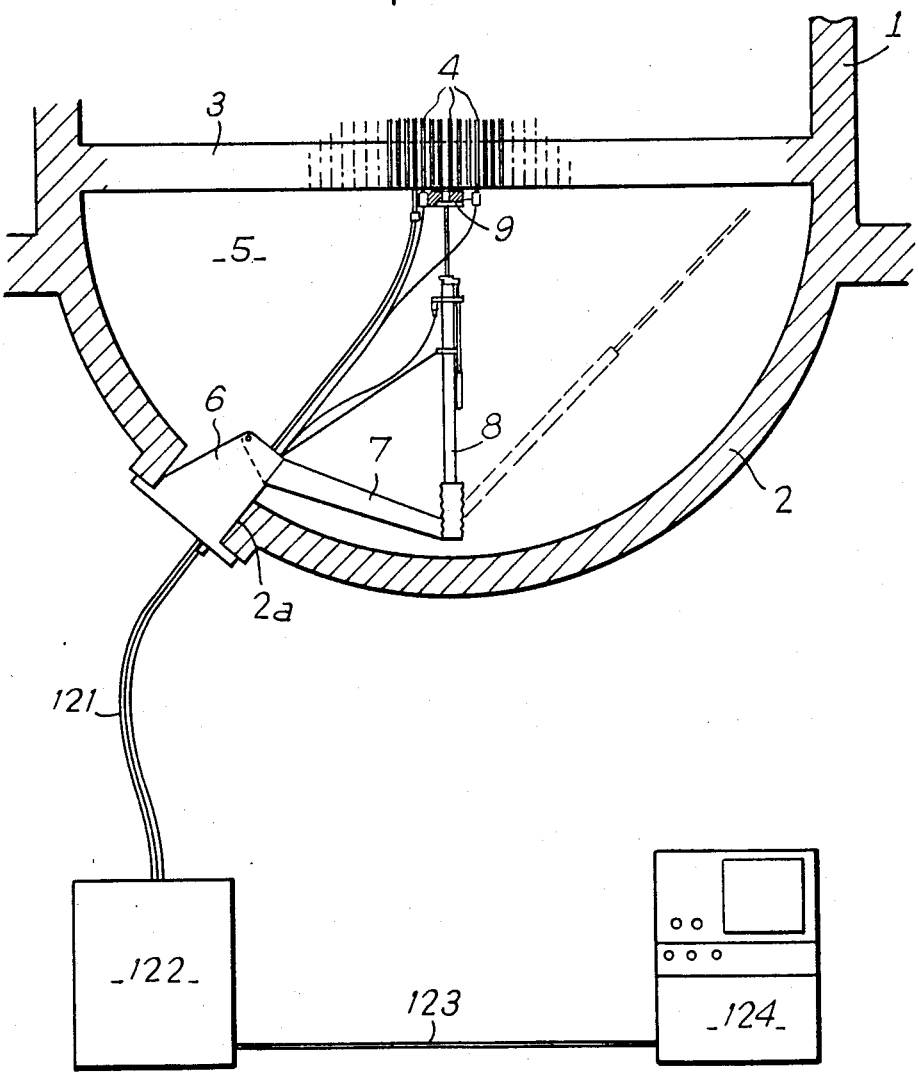
FIG. 4 is a schematic view in section of a steam generator in which is positioned the apparatus according to the invention in the phase of FIG. 3.

A steam generator comprises at its ends an enclosure defined by a spherical dome 2 which constitutes a water tank. Said enclosure is also defined by a perforated plate 3 perpendicular to the jacket of the generator and in the perforations of which are fixed tubes 4 which form a bank of tubes and which extend parallel to the longitudinal axis of the generator. The tubes 4, shown partly in FIG. 4, are regularly distributed over plate 3 at a well defined pitch p. The water tank 2 comprises a partition 5 which divides it into two equal parts lengthwise and which correlatively divides the plate 3 into two equal parts. Each of the parts of the water tank 2 comprises an access opening, or manhole, 2*a* which allows access to inside the enclosure.

The device according to the invention is introduced into the water tank via the manhole 2*a* and is composed of a frame 6 on which is pivotally mounted an arm 7 at the end of which is articulated a telescopic part 8 adapted to bear at its free end a tool-holder vehicle 9.

Figure 1:
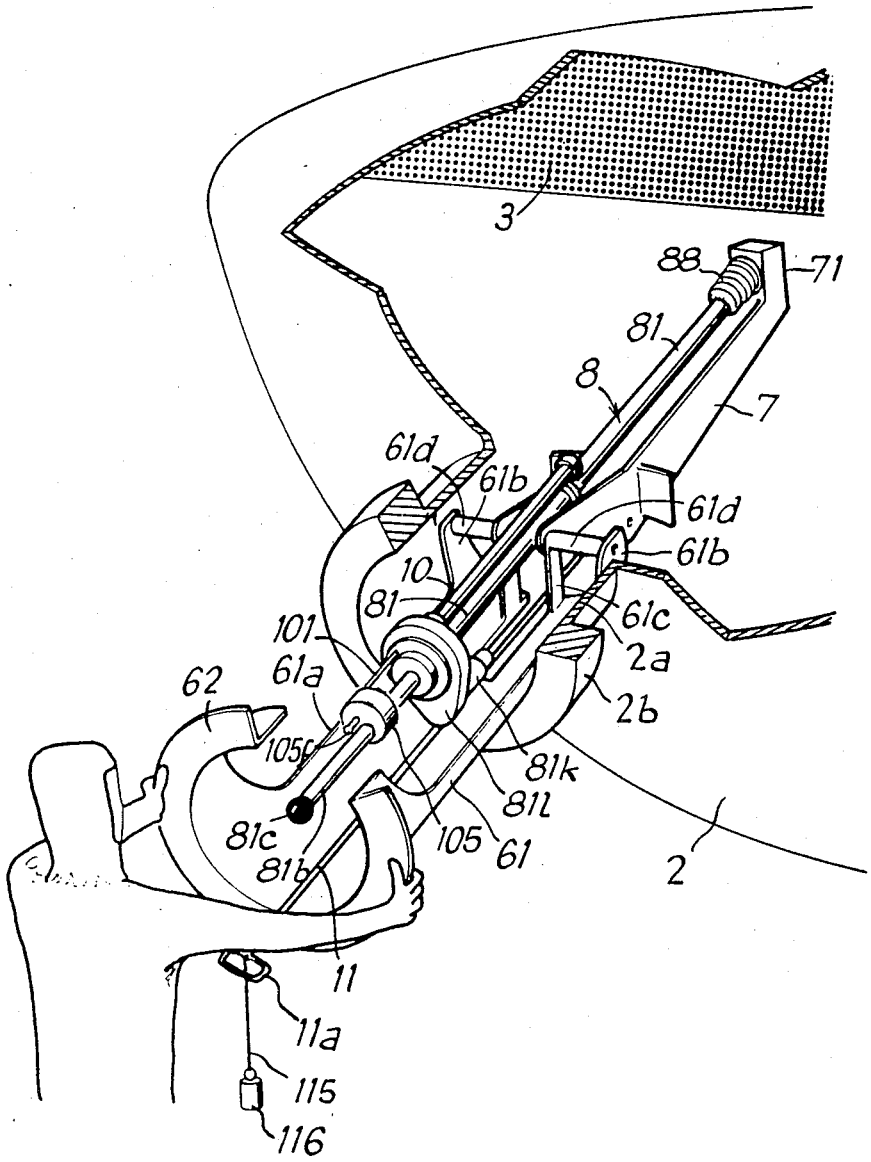
FIG. 1 is a schematic view in perspective of a device for selectively positioning a tool successively in front of each of the tubes of a bank of tubes, according to the invention, in the course of being positioned in the water tank of a steam generator.

The frame 6 is composed of a cylindrical structure 61 extending perpendicularly to a positioning ring 62 which comprises holes for fixation, for example four in number, to allow passage for bolts implanted in the flange 2*b* of the manhole 2*a* and to effect fixation of the apparatus on the steam generator by means of locknuts. The cylindrical structure 61 has an outer diameter such that it slides freely in the manhole 2*a*. It comprises on the side a wide notch 61*a* so that it adopts the general form of a gullet to receive the telescopic part 8 of the arm 7, when the latter is placed in line with the frame in position of introduction into the water tank as shown in FIG. 1. The structure 61 is cylindrical at its end located towards the ring 62 and comprises at its other end two tabs 61*b* which support, with two other intermediate tabs 61*c*, pin 61*d* on which the arm 7 is articulated. The length of the structure 61 is such that when the ring 62 is fixed to the manhole 2*a*, the end of the structure on which the arm 7 is articulated, lies inside the water tank 2.

Figure 3:
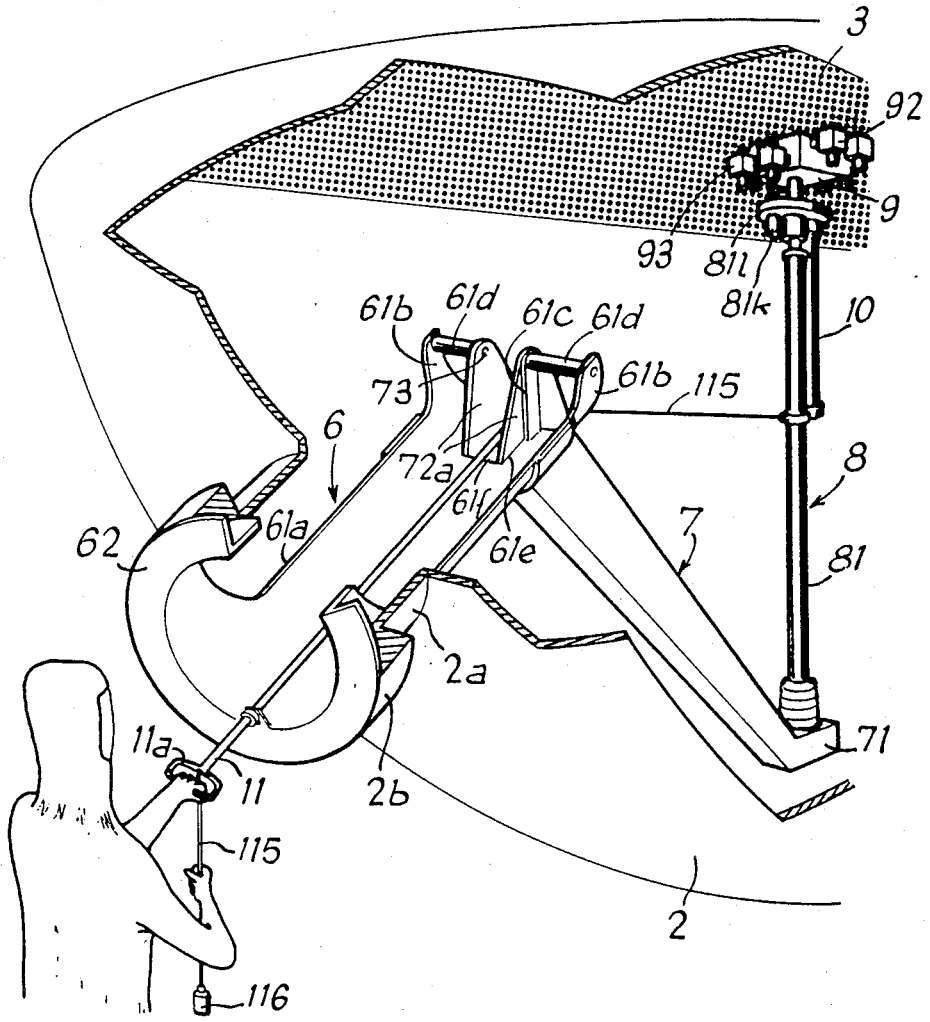
FIG. 3 is a schematic view in perspective of the apparatus of FIGS. 1 and 2 placed in position of operation at the beginning of a cycle of inspection of the bank of tubes.
Figure 5:
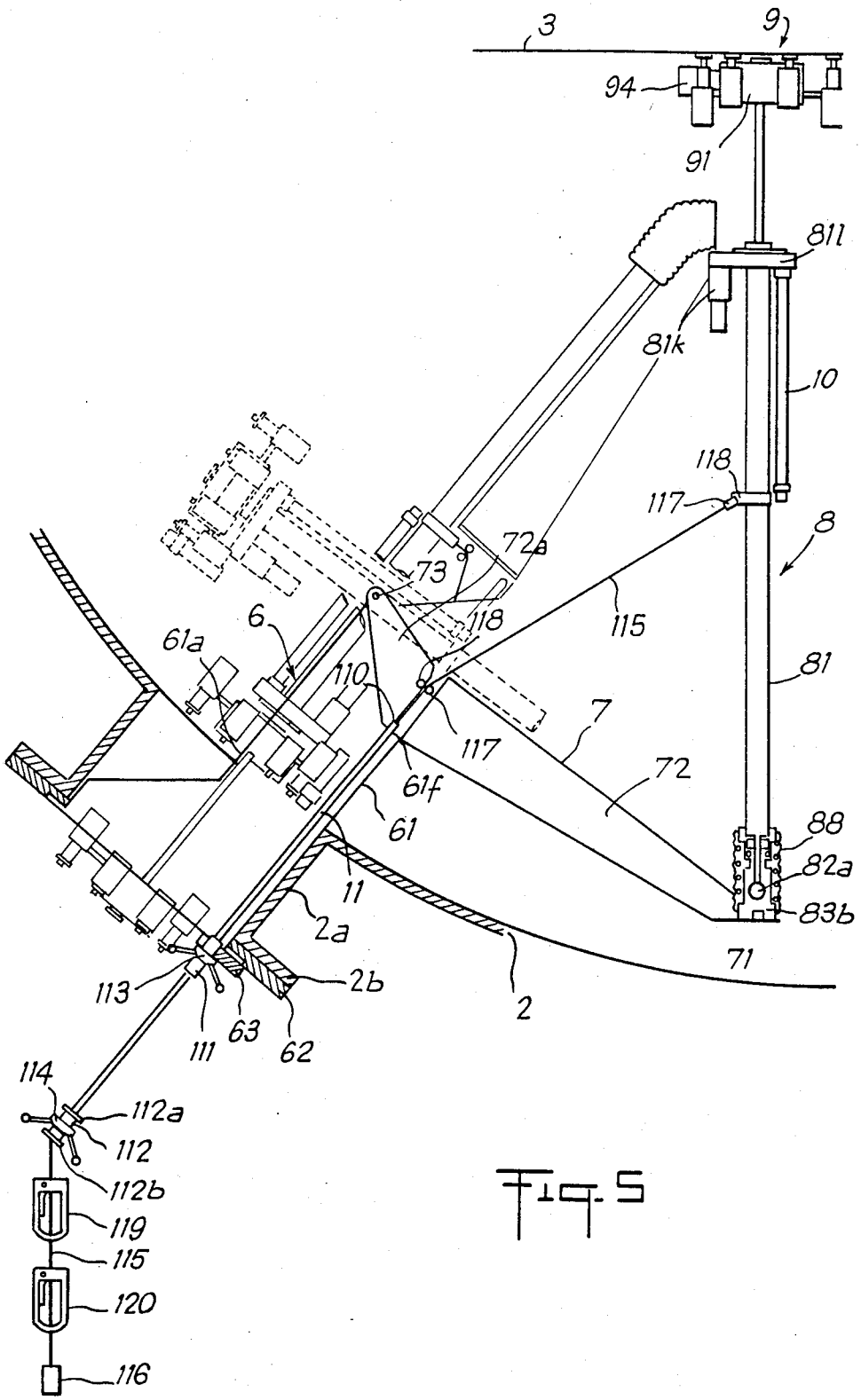
FIG. 5 is a view of the apparatus illustrated in FIG. 4, on a larger scale, the water tank of the steam generator being shown in part.

The arm 7 is mounted to pivot on the frame 6 and is of such a length that its front part 71 lies, when it is in pivoted working position as illustrated in FIGS. 3, 4 and 5, substantially in the central part of the water tank. The arm 7 is for example made of bent sheet metal and is of U-shaped cross section of which the section decreases progressively towards its end 71. The lateral walls 72 extend from its rear part to form two extensions 72*a* generally triangular in form. These extensions are pierced at their end to receive the pins 61*d* about which the arm pivots. In pivoted working position (FIGS. 3, 4, 5), the arm 7 is engaged in a rectangular notch 61*e* reserved in the cylindrical structure 61 of which the edge 61*f* constitutes a stop. The end 71 of the arm is bent so that, when the arm is in abutment on the stop 61*f*, the front part 71 is in a position substantially parallel to the perforated plate 3. This part 71 constitutes a bearing surface on which the telescopic part 8 is mounted in articulated manner. Said telescopic part is constituted by a double acting jack 81 called "thrust jack" whose function will be explained hereinafter.

Figure 6:
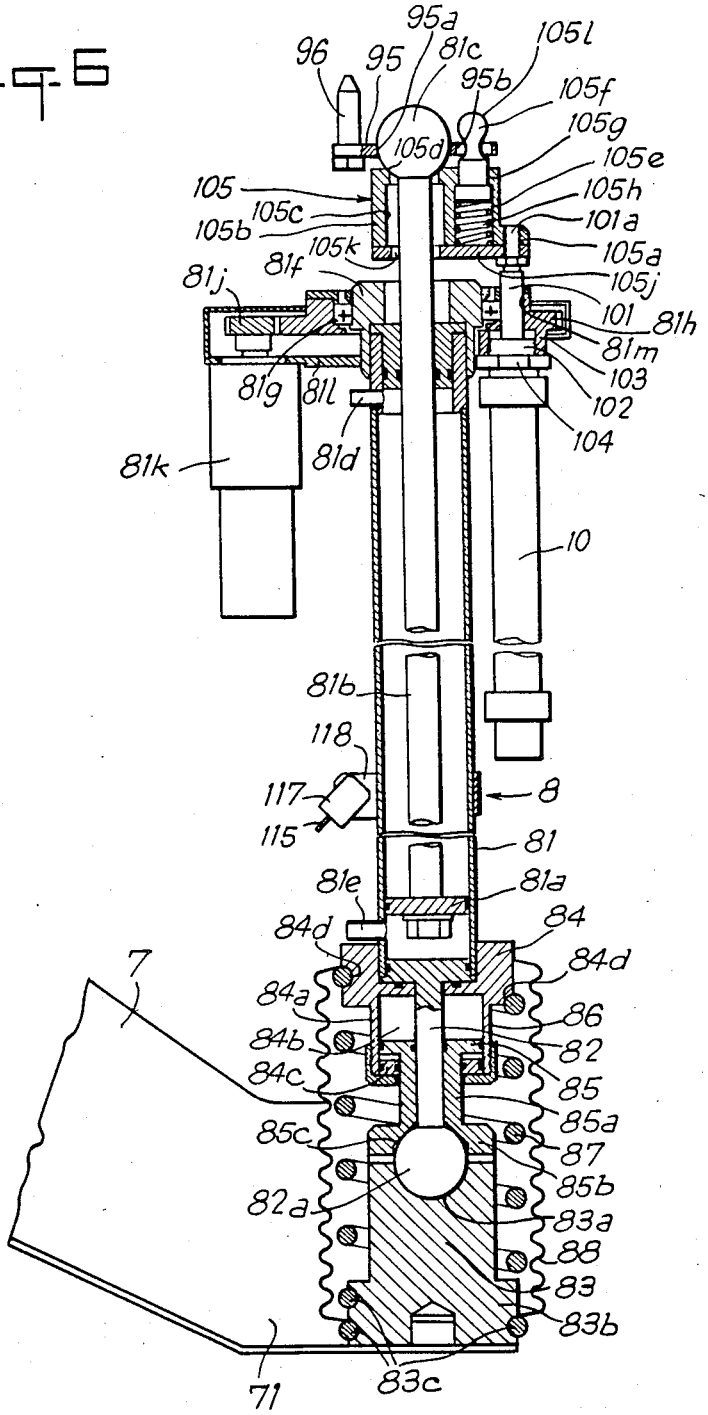
FIG. 6 is a view in section of the telescopic part of the articulated arm which composes the apparatus according to the invention.

Reference will now be made to FIG. 6 which shows in diametrical section the telescopic part 8 on a larger scale.

Figure 2:
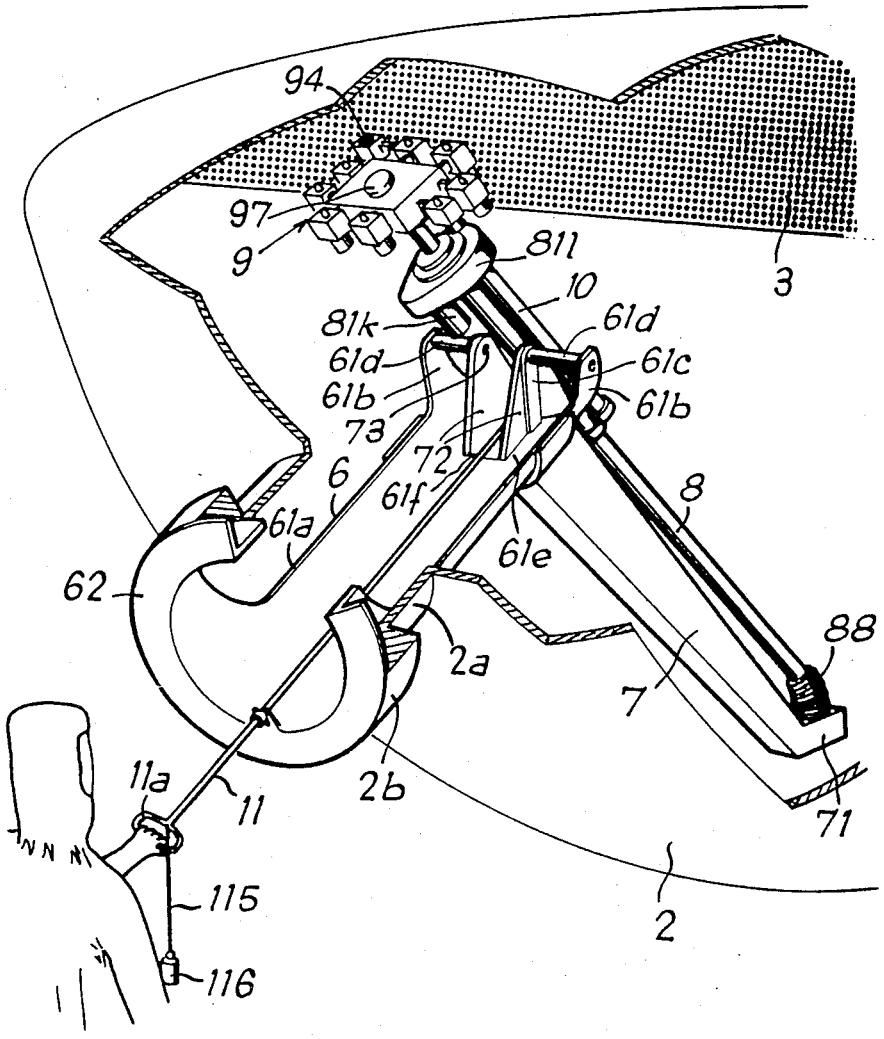
FIG. 2 is a schematic view in perspective of the apparatus of FIG. 1 of which the arm is placed in working position, the telescopic part carrying the tool-holding vehicle still being folded against the arm.

In pivoted position of the arm 7, the thrust jack 81 is, at the beginning of a cycle of intervention, in position substantially perpendicular to the plate 3. The body of the jack is extended in its rear part towards the bearing surface 71, by a pin 82 coaxial to the jack and comprising at its end a spherical protuberance 82*a*, which is engaged in a spherical housing 83*a* reserved in a cylindrical base 83, fixed to the bearing surface 71 of the arm 7, the assembly forming a swivel joint. The body of the jack 81 comprises in its rear part a ring 84 extending to its perphery and which is fast therewith, which ring extends on the base 83 side in a cylindrical wall 84*a* forming a chamber 84*b* which comprises at its end a wall 84*c*. The chamber 84*b* is traversed by the pin 82 which bears the swivel joint 82*a* around which pin is slidably mounted a piston 85 which moves in the chamber 84*b*. The piston 85 comprises a tubular extension 85*a* extending outside said chamber and comprising at its end a cylindrical head 85*b*, of the same diameter as the base 83. That part of the head 85*b* which is oriented on the base 83 side, comprises a housing 85*c*, for example conical. The piston 85, which bears the head 85*b*, moves in the cylindrical chamber 84*b*, this assembly constituting a jack 86, for example a double acting jack. During pressurization of chamber 84*b*, the piston is pushed towards the swivel joint 82*a*, which is inserted between the housing 83*a* of the base and the housing 85*c* of the head 85*b*, which has for its effect to connect the jack 81 and the arm 7 by blocking. The base 83 comprises, at its lower end, a part 83*b* of larger diameter whose periphery comprises a helical groove 83*c*. The ring 84 is of the same diameter as the widened part 83*b* of the base and, like the latter, comprises a helical groove 84*d*. The base 83 and the ring 84 are connected to each other by a helical spring 87, of which the turns are engaged in the grooves 83*b* and 84*d* of the base and the ring. The function of this spring is to tend to place the jack 81 in a position close to the perpendicular with respect to the bearing surface 71 during unfolding of the telescopic part 8 of the arm. With the action of spring 87, there may be associated the action of jack 86. For folding the jack 81 against the arm 7, as illustrated in FIG. 2, the jack 86 is depressurized, jack 81 articulates about the swivel joint 82*a*/83*a*. The assembly of the pieces which have just been described and which constitute the articulation of the telescopic part 8 on the arm 7 is surrounded by a protective bellows 88 made of elastomer.

In the body of jack 81 moves a piston 81*a* whose rod 81*b* comprises, at its free end, a spherical protuberance 81*c* forming a swivel joint. The fluid is admitted in the chambers via tubes 81*d*/81*e*.

Around the nose element of jack 81*f* is rotatably mounted on a ball or roller bearing 81*g* a toothed wheel 81*h*, which cooperates with a toothed pinion 81*j* set on the driven shaft of a gear down motor 81*k* disposed parallel to jack 81 and carried by a support 81*l* fixed to the nose element 81*f* and extending at right angles thereto on one side of the jack.

The toothed wheel 81*h* is pierced right through at 81*m* in that part of the wheel located around the roller bearing 81*g* and is traversed by the mobile rod 101 of a double acting jack 10 called "accompanying jack". The latter is screwed by its nose element 102, which is threaded, in a tapped tubular support 103, for example welded to the toothed wheel 81*h*. A locknut 104 ensures fixation of the jack 81 on its support.

The end 101*a* of the rod of the jack 10 is threaded and is screwed in a tapped hole 105*a* in a mount 105, extending on the side of the jack 10, which mount is traversed by the mobile rod 81*b* of the thrust jack 81. The mount 105 is composed of a body 105*b* comprising a bore 105*c* with a diameter clearly greater than that of the rod 81*b* of the thrust jack and in which it moves. In its part located towards the swivel joint 81*c*, it comprises a spherical seat 105*d*, adapted to cooperate with the swivel joint 81*c*, under the effect of the accompanying jack 10 or during the relative movement of the rods 81*b* and 101. The mount 105 further comprises a cylindrical housing 105*e*, in which is slidably mounted a finger 105*f* passed through a circular orifice 105*g* coaxial to the housing 105*e* and of smaller diameter. The finger 105*f* comprises, in its base, a part of larger diameter sliding snugly in the cylindrical housing 105*e*, which forms a peripheral shoulder coming into abutment on the upper part of the housing under the effect of a compression spring 105*h* maintained in said housing by a counter-plate 105*j* which closes this housing in its lower part. This counter-plate is pierced at 105*k* to allow the passage of the rod 81*b*. The finger adopts, at its end 105*l*, the form of a spherical protuberance.

Under the effect of the gear down motor 81*k*, the accompanying jack 10 is displaced in rotation about the thrust jack taking along in its stroke the mount 105 about the mobile rod 81*b* of the jack 81 and correlatively the displacement about this rod of finger 105*f*.

The function of this device is to effect orientation of the vehicle 9 and also to provoke connection thereof with jack 81 by blocking the swivel joint 81*c* against the body of the vehicle 9 under the effect of the accompanying jack 10, as will be set forth hereinafter in greater detail.

Reference will now be made in FIGS. 7 and 8 which represent the tool-holder vehicle 9 according to the invention.

Said vehicle is composed of a parallelepipedic body 91 with square base in which are mounted to slide two superposed transfer members 92/93 moving in planes parallel to each other and to the upper and lower faces of the body. The transfer member 92 moves in the direction of axis $XX_1$, member 91 in the direction of axis $YY_1$. The two members 92/93 therefore move in two perpendicular directions. As the two members are identical, only member 93 will be described, the reference letters which accompany the numerical reference 93 being applicable to the numerical reference 92, as shown in the drawing.

The transfer member 93 is composed of two cylindrical rods 93*a*/93*b* which extend parallel to the lateral faces 91*a*/91*b* of the body 91. The rods of member 92 are parallel to the lateral faces 91*c*/91*d* of said body.

These rods 93*a*/93*b* are longer than the body 91 and bear at their ends jacks 93*c*/93*d*/93*e*/93*f*. Rod 93*a* bears jacks 93*c*/93*d*, rod 93*b* bears jacks 93*e*/93*f*.

Said jacks are at right angles to the planes in which the members 92/93 move and are thus parallel to each other. Jacks 93*c*/93*e* are connected to each other by a spacer 93*g*, jacks 93*d*/93*f* by a spacer 93*h*. These spacers 93*g*/93*h* bear adjustable end-of-stroke stops 93*j*/93*k* to adjust the stroke of the transfer members as a function of the pitch of the perforations of the plate 3 in which the tubes of the bank of tubes are engaged. Said spacers also bear end-of-stroke contacts 93*l*/93*m* which surround the stops 93*j*/93*k* and which can be utilized with a circuit (not shown) to emit a signal giving the relative position of the transfer members with respect to the body 91. One form of such control that can be used is shown in U.S. Pat. No. 4,449,599.

As all the jacks which compose the transfer members 92/93 are identical, only jack 93*d*, shown in section in FIG. 8, will be described. Jack 93*d* is fixed to rod 93*a* by its part on which opens its mobile rod $93d_1$, which is fixed in known manner to a piston $93d_2$ which moves in a chamber $93d_3$. This jack is double acting and the rod $93d_1$ bears, opposite piston $93d_2$, a finger $93d_4$ whose end is conical to facilitate introduction of the finger in the tubes of the bank of tubes. The finger $93d_4$ slides snugly in said tubes so as correctly to position the vehicle on the plate and correlatively the tool level with the tubes. Penetration of finger $93d_4$ in the tubes is limited by a flange $93d_5$ forming stop.

The ends of the fingers of the transfer members 92/93 lie, in unfolded position, in the same plane parallel to the upper face of the body 91 to maintain the vehicle parallel to the perforated plate 3.

In retracted position, the fingers are outside the tubes, this enabling one of the transfer members 92/93 to move with respect to the body whilst the other is in mesh in four tubes of the bank of tubes.

Each rod 93a/93b further comprises two pistons 93n/93p each moving in a chamber 93q/93r in which is admitted a driving fluid. These chamber/piston assemblies constitute four double acting jacks whose function is to provoke transfer of the members 92/93. Chambers 93q are located towards the lateral face 91c, chambers 93r towards the lateral face 91d. Stoppers 93s, traversed by the rods 93a/93b, obturate said chambers level with the lateral faces 91c/91d.

The transfer member 93 comprises a tool support 94, which is fixed to the jack 93d via a web 94a. The support 94 adopts the form of a mandrel in which is fixed the tool. The term tool has been chosen to designate any member used in interventions currently carried out on the bank of tubes, for example support 94 carries a probe guide tube 94b. As shown in FIG. 7, the tool support 94 is aligned with the jacks 93d/93f on an axis parallel to the lateral face 91d.

In one embodiment, the distance separating jacks 93c/93e from jacks 93d/93f is nine pitches. The distance separating jacks 93c/93d from jacks 93e/93f is four pitches. The distance separating jack 93d from the tool support 94 is three pitches. The displacement of the transfer members 92/93 in one direction or in the other is one pitch.

The body 91 of the vehicle 9 comprises, in its lower part and its centre, a cylindrical housing 91e comprising a conical inlet, for example at 45°, 91f. At the centre of this housing 91e is reserved another housing 91g, which is spherical to receive the swivel joint 81c of the mobile rod 81b of the thrust jack 81. On the side of said spherical housing 91g is reserved a spherical cavity 91h to receive the spherical finger 105f of the mount 105, fixed to the mobile rod 101 of the accompanying jack 10. Finger 105f is elastically mounted in the mount 105 to overcome the defective positioning during the manoeuvre of orientation of the vehicle 9 by drive of the mount 105 about the swivel joint 81c under the effect of the gear-down motor 81k, the finger then being able to be offered against the bottom of the housing 91e and being placed in its adequate position by a rotation of the mount about the rod of the jack 81.

The vehicle 9 is coupled to the thrust jack 81 (FIG. 6) by means of a plate 95 comprising a spherical seat 95a adapted to come into contact with the swivel joint 81c of the jack 81. This plate is maintained prisoner between the swivel joint 81 and the nose element of the jack, and is traversed by the mobile rod 81b thereof.

On the side of the spherical seat 95a, the plate 95 comprises a hole 95b for the passage of the orientation finger 105f. On the side of the spherical seat 95a and diametrically opposite hole 95b, the plate comprises a finger 96 extending perpendicularly to the plate and on the side opposite the body of jack 81. The finger is parallel to the mobile rod 81b and its end 96a is conical to facilitate introduction thereof into a conduit 91j, reserved in the body 91 of the vehicle and diametrically opposite the spherical cavity 91h in which the finger 105f penetrates. The finger 96 comprises, at its conical end and at its centre, a tapped hole to make it possible to screw therein a threaded rod connected to a knurled knob 97, which is mounted to rotate in captive manner on the body of the vehicle 9 and is retained in translation, for example by a clip 98, fixed to said body 91 and engaged in a peripheral groove in the knob 97. When the screw 97 is blocked against the upper face of the body of the vehicle, the plate 95 is applied against the bottom of the housing 91e of said body. In this position, it maintains the swivel joint 81c prisoner in its housing 91g, which is free to rotate therein, the jack 81 thus being able to adopt the extreme position illustrated in chain-dotted lines in FIG. 8. Connection of the jack 81 and of vehicle 9 is obtained under the effect of the accompanying jack 10, which displaces the mount 105 until the seat 105d comes into contact with the swivel joint 81c, the pressure exerted by the mount 105 on the swivel joint 81c effects blocking of the assembly.

The device further comprises means for maintaining the arm 7 in line with frame 6, and for provoking tipping of the arm into work position as illustrated in FIG. 5 and for maintaining the arm in this position.

These means consist in a tubular rod 11 which is pivotally mounted at 110 about an axis extending transversely to the arm 7 between the two extensions 72. This rod is guided by a fork-shaped fitting 62, fixed on the outer face of the positioning ring 62. The rod may therefore be cleared on the side by the open part of the fork 63 or be placed in the bottom thereof. Over its length, it comprises two threaded sleeves which are fast therewith, of which one, 111, lies at the level of the fork 63 when the arm 7 is tipped into work position, in abutment on the stop 61f and the other, 112, lies at the level of said fork 63 when the articulated arm 7 is in position of introduction in the water tank, in line with the frame 6. A nut 113, manoeuvrable by short arms, is screwed around the sleeve 111. The arm 7 is blocked in work position when, the latter being in abutment on the stop 61f, the nut 113 is tightened against the fork 63.

Another nut 114, identical to nut 113, is screwed around the sleeve 112. The latter comprises, at its ends, two flanges 112a/112b. To immobilize the arm 7 in line with the frame 6, the sleeve 112 is engaged in the fork 63 and flange 112 is applied on the inner face of the fork. Nut 114 is then tightened against the outer face of the fork. Once loosened, as illustrated in FIG. 5, the nut 114 is prisoner between the two flanges 112a/112b and cannot be lost. The rod 11 may comprise a manoeuvring handle 11a.

The means for provoking folding of the telescopic part 8 of the articulated arm against part 7 and for maintaining it in folded position consist in a cable 115 passed inside the rod 11, which cable is attached to the body of the jack 81 substantially half way along it and extends outside the rod 11. The part extending outside the rod 11 is maintained taut by means of a weight 116. The cable 115 is passed between two grooved return rollers or rolls 117/118, mounted to rotate freely between the two extensions 72 of the arm 7 and comprises, at its end located on jack 81 side, a fork joint 117 articulated on a collar 118 which surrounds the body of the jack 82.

The means for blocking the cable 113 when the jack 81 is folded against the arm 7 consist for example in a self-locking handle 119 which, in this folded position of the telescopic part of the arm, is in abutment on the end 112b of the rod 11. A second self-locking handle 120 may be used to facilitate maneuvers. One form of such self-locking handle is shown in U.S. Pat. No. 4,395,920.

The telescopic part 81 of the arm is unfolded by unlocking handle 119 and releasing cable 113, the arm is then placed in the position substantially perpendicular to the plate 3 at the beginning of a cycle of scanning, under the effect of the spring 87 and possibly under the combined action of said spring and the vehicle 86.

The fluid controlling the assembly of the jacks which constitute the device, for example compressed air, and the electrical energy are conducted to the members of the apparatus by flexible cables 121, for example grouped together in a supple sheath and coming from a control cabinet 122, for example a pneumatic cabinet, which is connected by a line 123 to a control desk 124. The latter may comprise a television screen for receiving the images during scanning of the vehicle, coming from a camera carried by the arm, the vehicle being illuminated by a projector also carried by the articulated arm.

To position the device according to the invention in the water tank 2 of a steam generator for example, the arm 7 is placed in line with the frame 6, the rod 11 being blocked against the fork 63 by the nut 113; the telescopic part 8 is folded against the arm 7, the cable being blocked by the self-locking handle 119 placed in abutment on the rod 11. The assembly is introduced through the man hole 2*a* as shown in FIG. 1 of the drawings. At this stage, the vehicle 9 is not coupled to the mobile rod 81*b* of the thrust jack 81. The positioning ring 62 is applied against the flange 2*b* of the man hole and it is fixed to said flange. The cylindrical structure 61 sliding snugly in the man hole, the assembly is automatically placed in the suitable position. The outlet of the swivel joint 81*c* is controlled by acting on the accompanying jack 10 and said swivel joint is brought level with the outer limit where the positioning ring 62 is located.

The vehicle 9 is fixed on the swivel joint 81*c* by acting on the knurled knob 97. Jacks 10/81 are controlled to provoke introduction of vehicle 9 in the water tank 2, the rods of the jacks then being retracted.

Nut 114 is unlocked and rod 11 is manoeuvred to obtain tipping of the arm 7 until it comes into abutment on the stop 61*f* and nut 113 is blocked against fork 63. The device is then in position illustrated in FIG. 2.

The self-locking handle 119, which retained, under the tension of cable 115, the telescopic part 8 folded against arm 7, is unblocked. Under the effect of spring 87 and by release of cable 115, the telescopic part 8 straightens until it is immobilized in a position substantially perpendicular to the perforated plate 3. Such straightening may be obtained in certain cases under the combined action of the spring 87 and the jack 86.

Under the action of the thrust jack 81 and accompanying jack 10, vehicle 9 is placed in contact with the perforated plate 3, as illustrated in FIG. 3.

Figure 9:
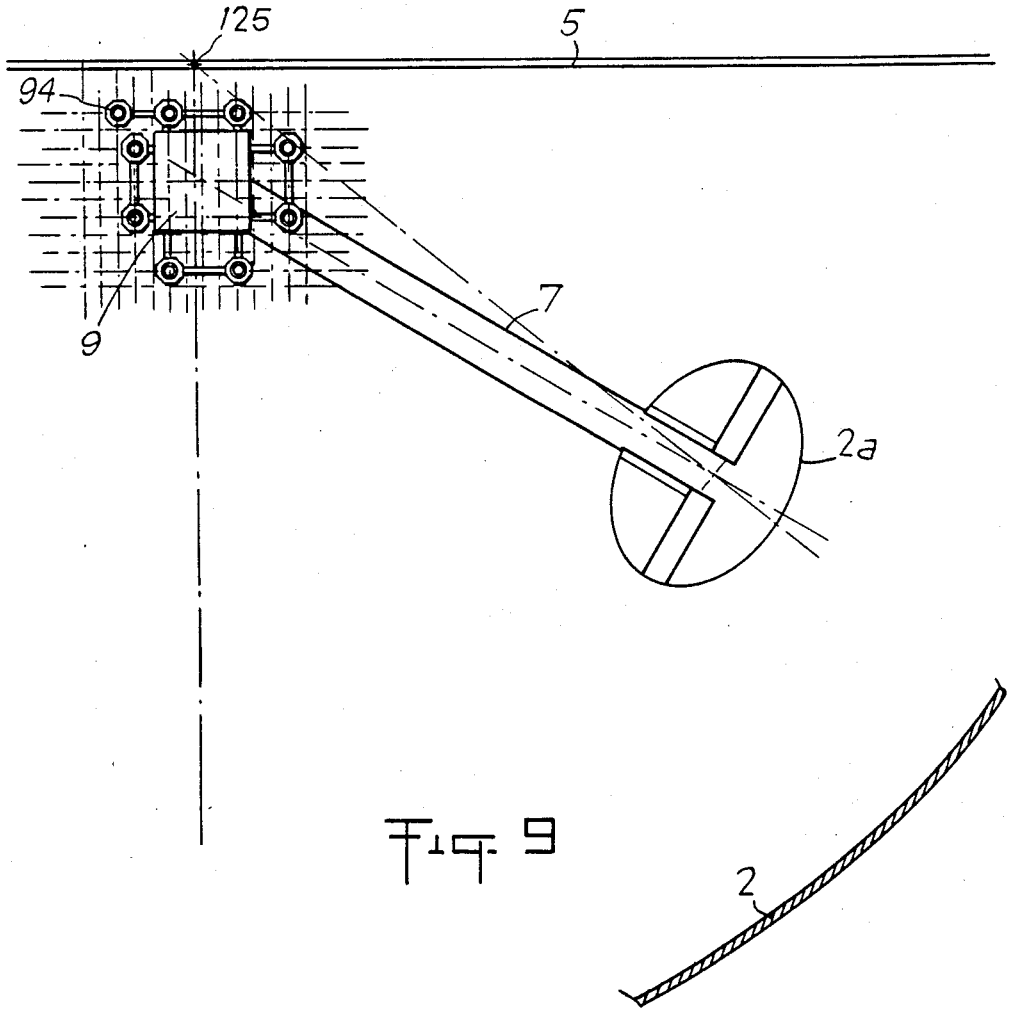
FIG. 9 is a partial plan view of a water tank illustrating the vehicle placed in position of operation at the beginning of a cycle of scanning of the bank of tubes in the central part of the perforated plate of the generator.

Pre-orientation of the vehicle 9 on the rods of jacks 10/81 as well as orientation of arm 7/8 with respect to the man hole 2*a* cause vehicle 9 to be placed in a position close to the centre 125 of the tubular plate 3 and near the partition 5 which divides the water tank (FIG. 9).

Vehicle 9 thus being in abutment against the perforated plate 3, the swivel joints 81*c* and 82*a* are unlocked by acting on the one hand on the accompanying jack 10 and on the other hand on the jack 86 of base 83. The action of jacks 92*c*/93*c*-92*d*/93*d*-92*e*/93*e*-92*f*/93*f* provokes penetration of fingers 93*d*$_4$ in the perforation of the tubular plate 3.

Displacement of the vehicle is effected in the following manner:

At the start, the eight fingers of the members 92/93 of vehicle 9 are engaged in the tubes.

Figure 7:
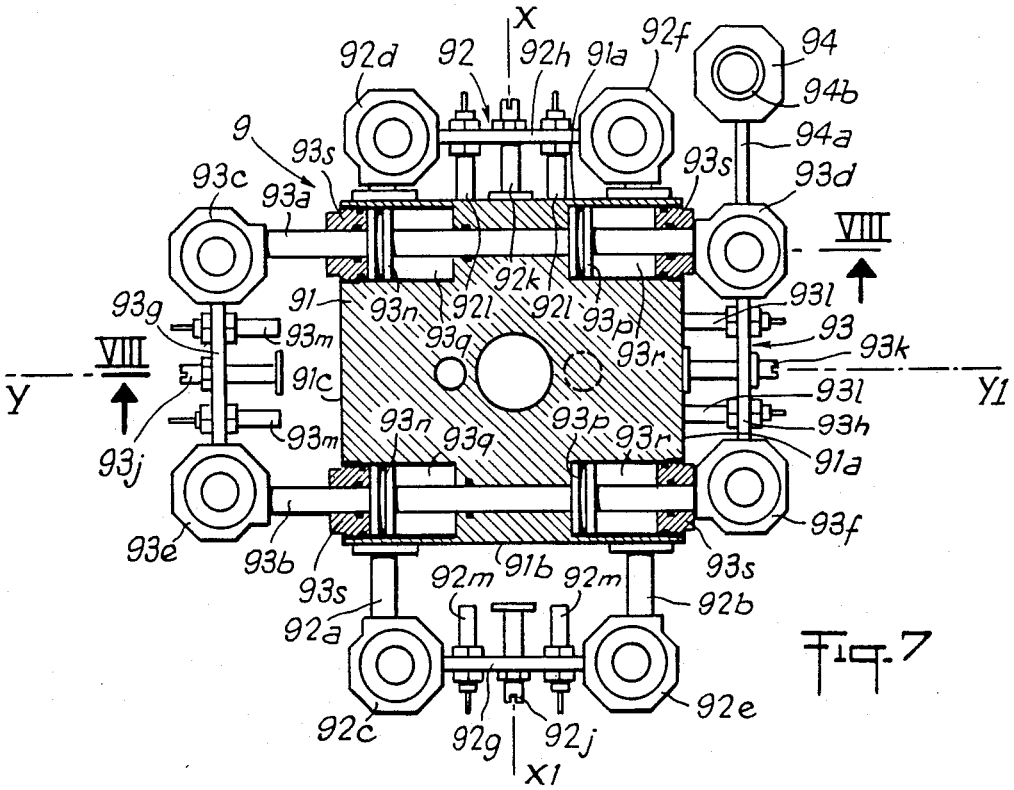
FIG. 7 is a view in section along VII—VII of FIG. 8 illustrating the tool-holder vehicle.

The direction of displacement of the vehicle is selected, for example direction $YY_1$ (FIG. 7).

The four fingers 93*d*$_4$ of one of the two transfer members, for example member 93, are retracted and this member is displaced by one step by acting on the jacks 93*n*/93*p* integrated in body 91. At the end of this displacement, the fingers of member 93 are engaged in four new tubes and the four fingers of member 92 are retracted.

The jacks 93*n*/93*p* are actuated again and the body 91 and the member 92 that it carries is displaced by one step.

The fingers of member 92 are engaged in four new tubes.

The fingers 93*d*$_4$ of member 93 are retracted and member 93 is displaced by a fresh step, and so on . . . .

The same procedure is carried out with the other transfer member 92 for displacing the vehicle in direction $XX_1$. At each displacement by one step in one or the other orthogonal direction, the vehicle places the tool support coaxially to a tube and the tool is controlled to carry out the intervention on this tube. During scanning of the bank of tubes, the vehicle is maintained in position permanently against the perforated plate, the telescopic arm 8 being articulated around the swivel joint 82*a*.

Figure 8:
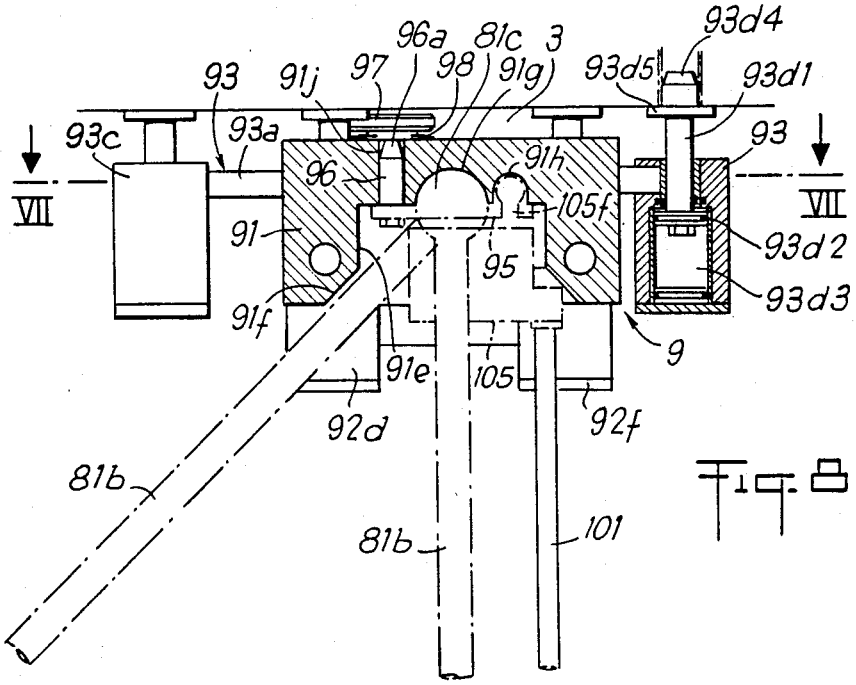
FIG. 8 is a view in section along VIII—VIII of FIG. 7.

Total scanning of the tubular plate is effected by means of the device for rotating the vehicle 9 around the swivel joint 81*c* of the thrust jack 81, by actuating the gear down motor 81*k* and the jack 10, the finger 105*f* being engaged in the cavity 91*h* (FIGS. 6 and 8).

This device makes it possible to position the vehicle 9 and therefore the tool in four positions at 90° with respect to one another.

To obtain this rotation, it is necessary:

- to return the vehicle 9/telescopic arm 8 assembly in position substantially perpendicular to the perforated plate 3;
- to block the swivel joints 81*c*/82*a* by acting on jacks 10 and 86;
- to conduct vehicle 9 on the nose element of the thrust jack 81.

The position of the vehicle is made when it is returned on the nose element of the thrust jack 81. By controlling the gear down motor 81*k*, the toothed wheel 81*h* is driven, which drives in rotation through 90° the accompanying jack 10 connected to vehicle 9 by finger 105*f*.

The vehicle is then returned into position against the tubular plate for a fresh passage.

When scanning of the tubes of the bank of tubes is terminated, the device is withdrawn from the water tank in the following manner;

- the vehicle 9 and the telescopic arm 8 are returned into position substantially perpendicular to the perforated plate 3 by displacing the vehicle on the plate;
- the swivel joints 81*c*/82*a* are blocked by acting on jacks 10 and 86;
- the vehicle 9 is brought onto the nose element of the thrust jack 81;
- the swivel joint 82*a* is unlocked by acting on jack 86;
- a traction is exerted on cable 115 to fold the telescopic part 8 which carries the vehicle 9 against the pivoting arm 7 and to place it in the position illustrated in FIG. 2 and the cable is blocked by means of the self-locking handle 119;
- the nut 113 is loosened, the rod is disengaged from the fork 63 and rod 11 is pushed to place the pivoting arm 7 and the telescopic part 8 in line with the frame 6 substantially in the axis of the man hole 2*a;* the accompanying jack 10 is actuated and the vehicle 9 is displaced until it is presented at the entrance of the man hole 2*a;* the vehicle 9 is disconnected from arm 7-8 by loosening the knurled knob 97;

and the frame 6/arm 7-8 assembly is withdrawn from the water tank 2.

Introduction, positioning and operation of the device according to the invention are effected from outside the water tank. At no moment is there any need for human intervention inside the generator.

In the event of breakdown, the positioning vehicle 9 is maintained against the tubular plate 3 by the thrust jack 81. In that case, it is also possible to recover the device without it being necessary to penetrate in the water tank.

Displacement of the vehicle 9 in two orthogonal directions and rotation thereof about the swivel joint 81*c* ensure scanning of all the tubes of the bank of tubes of the steam generator, which is programmed in four zones.

The elements which have just been described by way of example may, of course, be replaced by equivalent elements performing the same function, without departing from the scope of the invention.

What is claimed is:

1. A device for selectively positioning a tool carried by a vehicle on the perforated plate of a bank of tubes regularly distributed and fixed to the plate to present the tool successively in front of each tube, which plate is located in an enclosure comprising an opening giving access of which the vehicle comprises two superposed transfer members mounted to slide in a central body for moving in parallel planes and in two perpendicular directions, which members comprise means for causing positioning fingers to penetrate in said tubes or for causing said fingers to leave said tubes, the fingers of one of the members penetrating in the tubes while the fingers of the other are retracted to allow the displacement of the member which carries them at a pitch corresponding to that of perforations of the perforated plate, and to obtain the displacement of the vehicle against said plate, at least one of said members comprising a tool support wherein the said vehicle is carried by a telescopic arm composed of two parts articulated one of the other, the assembly being mounted to tip on a frame fixed to the opening giving access to the enclosure and extending therein, the part connected to the frame being of fixed length, the other part which is articulated thereon being telescopic and connected to the said part of fixed length by means of a ball swivel, said telescopic part comprising at its free end a second ball swivel which cooperates with a spherical housing reserved in the vehicle and means for coupling the vehicle to said arm, means for controlling the folding of the telescopic part against that part of the arm connected to the frame or the unfolding of said telescopic part, and means for placing the arm in line with the frame or for controlling tipping thereof in the enclosure with a view to placing the vehicle in position of operation in contact with the central part of the perforated plate.

2. The device of claim 1, wherein the central body takes the form of a straight parallelepipedic block and each transfer member comprises two assemblies of two jacks connected together by rods which pass through said body, which rods are parallel to one another, to the upper and lower faces of the body and to two of its lateral faces, which assemblies are connected together by spacers perpendicular to said rods, each spacer connecting a jack of one assembly and a jack of the other located on the same side, which spacers are parallel to one another and to the other two lateral faces of the central body.

3. The device of claim 2, wherein the free ends of the positioning fingers are, in extended position, located in the same plane and each of the fingers comprises a stop which delimits the penetration of the finger in the tubes, which stops are located at the same distance from the end of the fingers to maintain the vehicle parallel to the perforated plate.

4. The device of claim 2, wherein said transfer members comprise rods of circular cross section, wherein each rod comprises at least one piston fast with the rod and moving in at least one jack chamber reserved in the mass of the central body to provoke the displacements of said members and correlatively the transfer of the vehicle.

5. The device of claim 2, wherein the perforations of the plate are distributed at a pitch p, wherein the tool support is aligned with two of the jacks connected by a spacer and composing one of said transfer members, which support is parallel to said jacks and is separated from the closest jack by a distance equal to 3*p* in order to be offered coaxially to each of said tubes of the bank of tubes.

6. The device of claim 5, wherein the distance between the jacks connected by said rods is 9*p* and the distance between the jacks connected by said spacers is 4*p*.

7. The device of claim 1, wherein, in tipped position, that part of the arm which is connected to the frame has its end, on which is articulated the telescopic part, located in the central part of the enclosure to place said telescopic part in a position substantially perpendicular to the central part of the perforated plate, with a view to allowing all the tubes of the perforated plate to be scanned.

8. The device of claim 1, wherein that part of the arm connected to the frame is bent at its end on which is articulated the telescopic part, which end comprises a bearing surface which, in tipped position of the arm, lies in a plane substantially parallel to the perforated plate and unfolding of said telescopic part is obtained by elastic means which tend to place said telescopic part in a position substantially perpendicular to said bearing surface of the arm.

9. The device of claim 8, wherein the swivel joint which allows articulation of the two parts of the arm cooperates with a spherical housing reserved in a base fixed to said bearing surface of the arm and said elastic means consist in a helical spring fixed on the one hand around said base and on the other hand around the rear end of said telescopic part.

10. The device of claim 9, wherein the telescopic part of the arm is constituted by a double acting jack, called "thrust jack", having a mobile rod which comprises at its free end said swivel joint which cooperates with the spherical housing of the vehicle and a body which is extended in its rear part by a shaft coaxial to said jack and comprising at its end said swivel joint which cooperates with the spherical housing reserved in said base of the arm.

11. The device of claim 10, wherein the body of the jack comprises, in its rear part, a ring which is fast therewith around which is fixed said helical spring, which ring extends on the base side to form a cylindrical chamber in which moves a piston mounted to slide about the shaft which bears the swivel joint, which piston comprises a tubular extension extending outside said chamber and comprising, at its end, a head in which is reserved a housing adapted to receive the swivel joint and to come into forced abutment thereon to block said jack on the base of the arm.

12. The device of claim 11, including a second double acting jack, called "accompanying jack", disposed parallel to and in the same direction as the "thrust jack", which accompanying jack is fixed to a toothed wheel extending perpendicularly to said jacks and mounted to rotate about a nose element of the thrust jack, which toothed wheel meshes with a pinion set on the driven shaft of a gear-down motor, fixed to a support fast with the body of the thrust jack, and the mobile rod of the accompanying jack passes through said toothed wheel and bears, at its end, means for blocking the vehicle on the articulated arm and means for orienting the vehicle about the swivel joint of the thrust jack.

13. The device of claim 10, wherein the means for coupling the vehicle to the articulated arm consist of a plate mounted prisoner about the rod of the thrust jack and comprising a spherical seat to come into contact with the swivel joint and contain the latter in the housing reserved in the body of the vehicle, which plate further comprises at least one finger which is perpendicular thereto, which finger is passed in a conduit which passes through said body and on which is screwed a tightening member mounted to rotate in captive manner on the body of the vehicle and coming into abutment on the upper face thereof.

14. The device of claim 12, wherein the means for blocking the vehicle on the arm consist of a mount extending on the side of the rod of the accompanying jack, which mount is traversed by the rod of the thrust jack of which the end comprises said swivel joint and the mount comprises, on the side of this swivel joint, a spherical seat adapted to come into abutment with the swivel joint under the effect of the accompanying jack in order to block the swivel joint in the housing reserved in the body of the vehicle.

15. The device of claim 14, wherein the means for orienting the vehicle about the swivel joint of the thrust jack are composed of a finger borne by said mount and extending parallel to the rod of the thrust jack, which finger passes through an orifice made in said plate to penetrate in a cavity reserved in the body of the vehicle and on the side of the spherical housing of the swivel joint.

16. The device of claim 15, wherein the finger for orienting the vehicle is spherical at its end and the cavity in which it penetrates is also spherical, and it is mounted to slide in a cylindrical housing reserved in the mount, in which housing it is pushed outwardly of the mount under the effect of a compression spring.

17. The device of claim 16, wherein the spherical housing of the swivel joint, the cavity of the finger for orienting the vehicle and the conduit of the finger of the plate are located in the bottom of a housing reserved at the centre of the body of the vehicle.

18. The device of claim 17, wherein the frame is composed of a cylindrical structure, open on the side and comprising at one of its ends a positioning ring perpendicular and coaxial to said structure and fixed on the flange of the opening for inspection of the enclosure and comprising at its other end the telescopic arm mounted in articulated manner, which, in tipped working position, is in abutment on a stop constituted by a notch reserved in the cylindrical structure and, in position of introduction in the enclosure, is in line with the structure, the telesopic part folded against the arm being placed substantially at the centre of the positioning ring and level with the open part of the structure.

19. The device of claim 18, wherein the means for controlling tipping of the telescopic arm are composed of a tubular rod mounted to slide in a fork-shaped fitting, which rod is articulated on the telescopic arm and extends outside the enclosure and comprises locking means for immobilizing the arm in position of introduction in the enclosure or in tipped working position.

* * * * *